US007214039B2

(12) United States Patent
Angove

(10) Patent No.: US 7,214,039 B2
(45) Date of Patent: May 8, 2007

(54) INTEGRATED RATIO PUMP AND CHECK VALVE APPARATUS

(75) Inventor: Garret Angove, Osterville, MA (US)

(73) Assignee: Sapphire Engineering, Inc., Pocasset, MA (US)

( * ) Notice: Subject to any disclaimer, the term of this patent is extended or adjusted under 35 U.S.C. 154(b) by 484 days.

(21) Appl. No.: 10/887,627

(22) Filed: Jul. 12, 2004

(65) Prior Publication Data

US 2006/0008369 A1 Jan. 12, 2006

(51) Int. Cl.
*F04B 39/10* (2006.01)
*F16J 15/16* (2006.01)

(52) U.S. Cl. ..... 417/559; 92/165 R

(58) Field of Classification Search ..... 92/165 R; 277/563; 417/559
See application file for complete search history.

(56) References Cited

U.S. PATENT DOCUMENTS 1,546,596 A * 7/1925 Mader ..... 92/165 R
3,030,118 A * 4/1962 Groce ..... 277/563
3,053,195 A * 9/1962 Williamson ..... 92/165 R
3,943,717 A * 3/1976 Schexnayder ..... 277/513
4,883,409 A * 11/1989 Strohmeier et al. ..... 417/265
7,080,975 B2 * 7/2006 Besse et al. ..... 92/165 R

FOREIGN PATENT DOCUMENTS

FR 2639066 * 5/1990
GB 2188437 * 9/1987

* cited by examiner

*Primary Examiner*—Michael Koczo, Jr.
(74) *Attorney, Agent, or Firm*—Paul J. Cook

(57) ABSTRACT

A pump apparatus is provided which comprises a plurality of displacement pumps each connected to a check valve apparatus. The displacement pumps each comprises a reciprocating piston within a housing having an interior wall spaced apart from the piston. The check valve apparatus comprises two check valves that control fluid flow under pressure exerted by the reciprocating piston from a fluid reservoir to a point of use of the fluid. Pistons of the displacement pumps are driven by a common motor.

10 Claims, 5 Drawing Sheets

INTEGRATED RATIO PUMP AND CHECK VALVE APPARATUS

BACKGROUND OF THE INVENTION

This invention relates to an integrated ratio pump and check valve apparatus for pumping a plurality of discrete liquid volumes to points of use of the liquid volumes. More particularly, this invention relates to an integrated ratio displacement pump and check valve apparatus for pumping a plurality of discrete liquid volumes to points of use.

At the present time, discrete liquid volumes are pumped with a syringe pump comprising a barrel, a face seal which moves within the barrel and a reciprocating plunger attached to the face seal. The syringe pump includes a valve construction formed of a polymeric composition which directs the pumped liquid volumes to a point of use. The valve construction includes a housing (stator) having a hollow, essentially interior surface into which is press fit a mating rotor. The rotor is provided with fluid passageways that control flow of liquid into the syringe pump and flow of liquid from the syringe pump while providing sealing between a pump inlet and a pump outlet. This configuration of syringe pump and rotor-stator valve requires two motors, one to drive the syringe and a second to drive the rotor.

While the available syringe pumps have been useful for their intended purpose, they also have disadvantages. In order to attain a tight fit between the barrel and the face seal, the manufacturing of both the barrel and face seal must be made at tight tolerances. In addition, when utilizing the most commonly used materials comprising a glass barrel and a polytetrafluoroethylene (PTFE) face seal, undesirable shedding of the PTFE occurs which contaminates the liquid being pumped. Furthermore, a tight fit between the barrel and face seal results in chattering of the face seal during its movement within the barrel. This leads to a loss of control of the liquid volume being pumped. In addition, the average useful life of presently available syringe pumps is only about 10 to about 100,000 cycles.

The presently available syringe pumps also are capable of pumping only a single liquid. Oftentimes it is desirable to provide a mixture of two or more liquid compositions for specific purposes. The provision of such liquid mixtures is not possible with presently available syringe pumps.

Accordingly, it would be desirable to provide a pump apparatus capable of delivering discrete liquid volumes to a point of use such as different areas of a sample tray in a manner which is repeatable for long time periods of 1,000,000 cycles or more. In addition, it would be desirable to provide such a pump apparatus which avoids shedding of particles during pumping. Furthermore, it would be desirable to provide such a pump which eliminates the need for a motor to activate a seal in order to direct fluid to a desired point of use. In addition, it would be desirable to provide such a pump apparatus capable of pumping a plurality of liquids in precise volume ratios.

SUMMARY OF THE INVENTION

The present invention provides a pumping apparatus comprising a plurality of sets of (a) a displacement pump having a liquid displacement element comprises a piston housed within a barrel, a high pressure seal and means for reciprocating the piston within the barrel and (b) check valves wherein the sealing is effected by activating a movable element under pressure of fluid being pumped without use of a motor. The pistons of each displacement pump are reciprocated by a common motor. Liquid in the barrel of each displacement pump is delivered to a point of use while the piston is traveling toward a check valve positioned between the piston and the point of use and liquid is supplied to each barrel when the piston is traveling away from the check valve positioned between the piston and the point of use. Each moving piston is spaced apart from the inside surface of each barrel so that a frictional force between the piston and the barrel is prevented during pumping. By providing check valves (a) between the piston and the point of use and (b) between the piston and a source reservoir for the liquid, motors for positioning the valves can be eliminated.

DESCRIPTION OF SPECIFIC EMBODIMENTS

Figure 4:
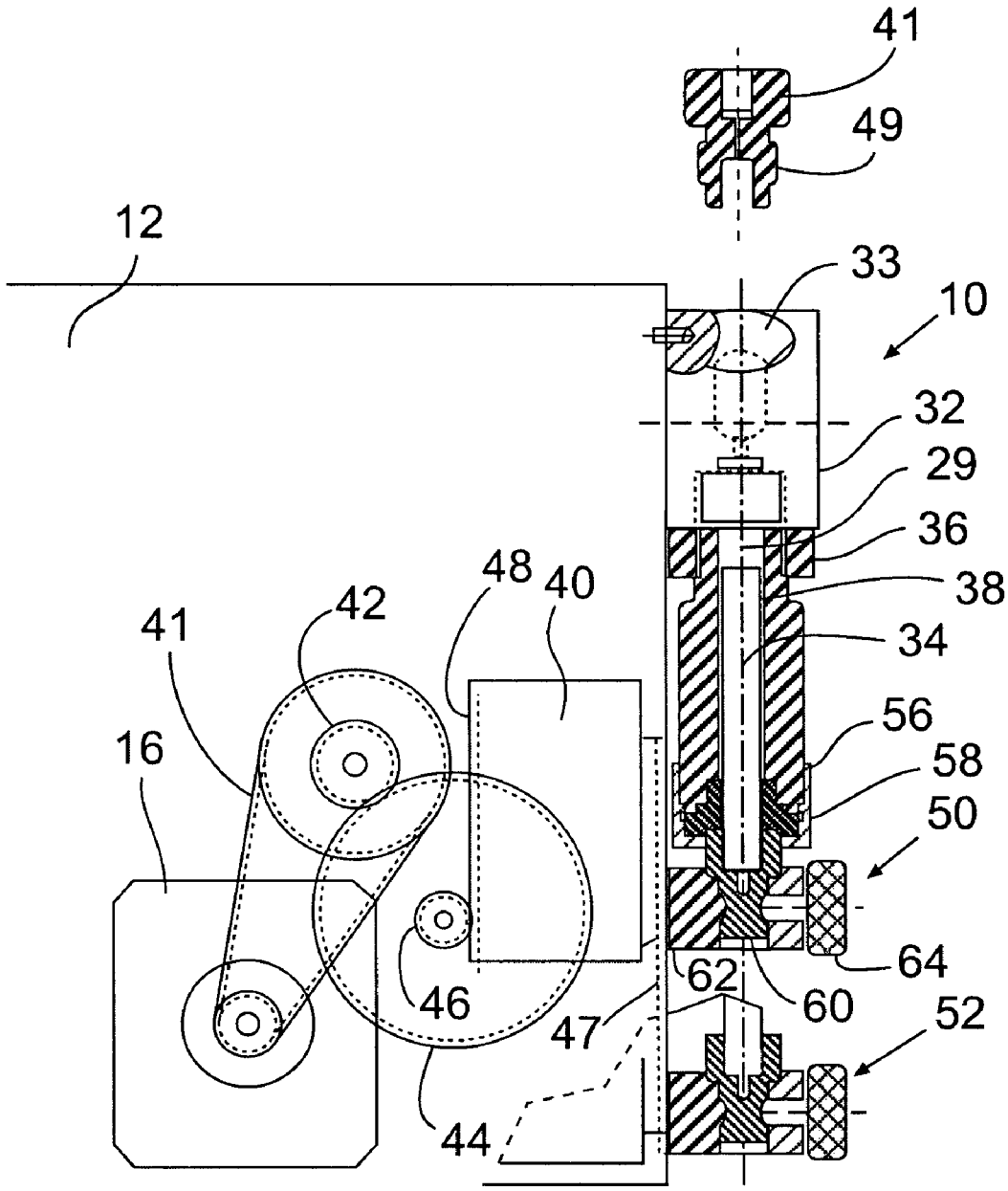
FIG. 4 is a side view of a displacement pump and check valve apparatus of this invention.

Referring to FIG. 4, the pump apparatus 10 of this invention includes a housing 12 and a motor 16 which effects rotation. Housing 32 which can be formed of an opaque or transparent material which is resistant to the liquid being pumped such as acrylic, polyetherether ketone, or the like can be a single piece or a plurality of joined elements. Each piston 34 of each pump can be formed of sapphire, glass or a ceramic or the like and is spaced apart from the interior wall 38 of housing 32 to form a barrel 29. When each piston 34 is so-positioned, a single stroke of each piston 34 during use of the pump will deliver a known volume of liquid depending upon the piston diameter, the barrel diameter and the stroke length. The provision of a single element housing provides the advantage that the valve seats and displacement pump of this invention can be replaced simultaneously after the useful life of the pump is completed.

Motor 16 causes gear box 40 to reciprocate through pulley 41, and gears 42, 44 and 46 and gear track 48. Gear box 40 is positioned within track 47 which causes the piston 34 of each pump to move in a repeatable linear path stroke after stroke. As shown in FIG. 4, the stroke of the pump varies from position 50 and position 52 which typically can be between about 1.5 and 2.0 inches. It is to be understood that any conventional activating apparatus which causes each piston 34 to reciprocate on a linear path can be utilized in the present invention.

Figure 1C:
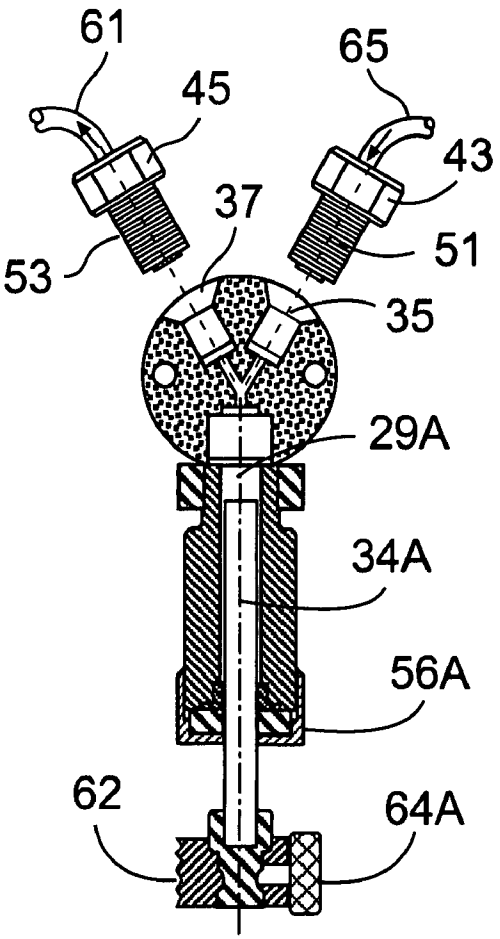
FIG. 1C is a cross-sectional view of the displacement pump and check valve apparatus of FIG. 1B taken along line 1C—1C.
Figure 1B:
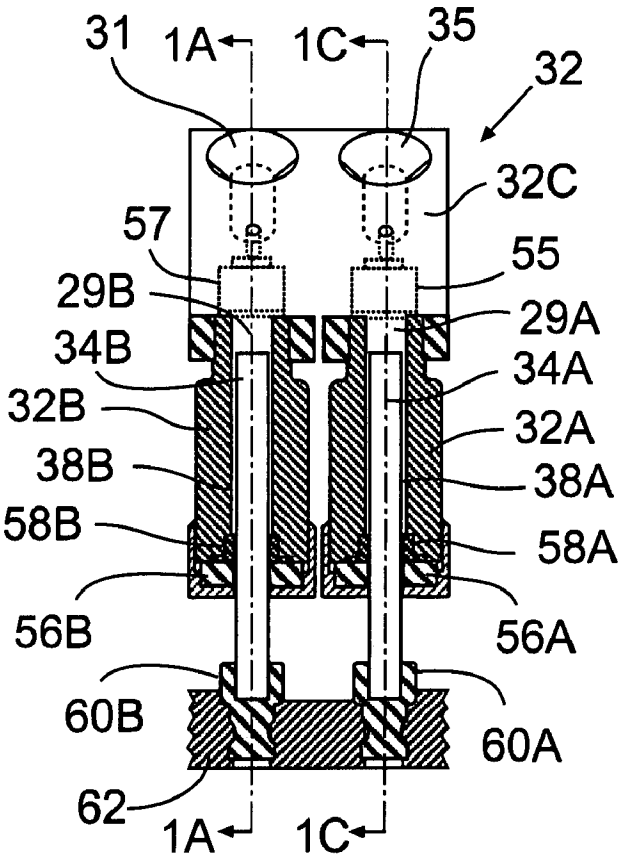
FIG. 1B is a front view of the displacement pump and check valve apparatus of FIGS. 1A and 1C.
Figure 1A:
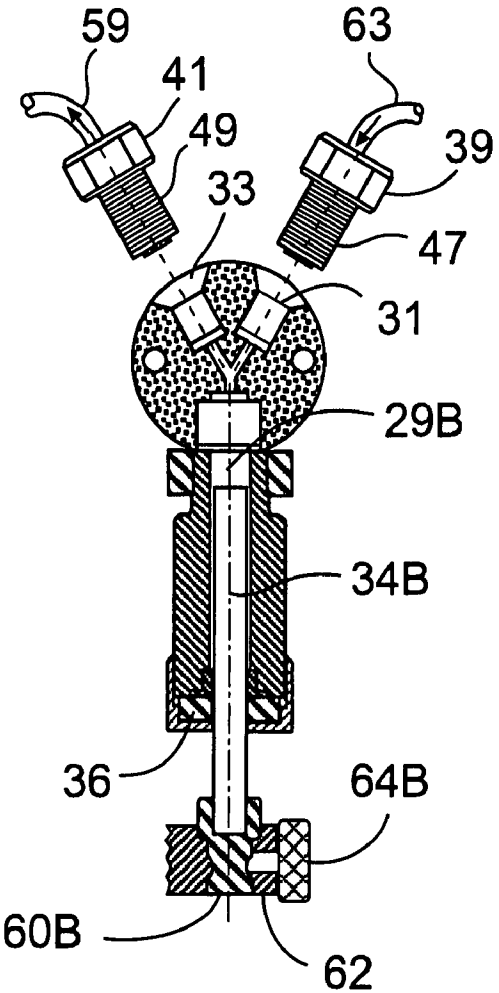
FIG. 1A is a cross-sectional view of the displacement pump and check valve apparatus of FIG. 1B taken along line 1A—1A.

FIGS. 1A, 1B and 1C show the embodiment of this invention wherein two liquids are simultaneously pumped without the use of a wash liquid for the pump seals. Each piston 34A and 34B is positioned within a seal 56A or 56B which can be formed, for example of ultra high molecular weight polyethylene (UHMWPE) or the like and optional roulon guide 58A or 58B. The roulon guides 58A and 58B align pistons 34A and 34B into seals 56A and 56B. The pistons 34A and 34B reciprocate within seals 56A and 56B and roulon guides 54A and 54B. The pistons 34A and 34B are fixedly positioned in ferrules 60A and 60B which, in turn, are fixed within arm 62 by knobs 64A and 64B. Both pistons move when arm 62 is moved. The volume ratio of the liquids delivered from barrels 29A and 29B with a single stroke of pistons 34A and 34B is controlled by the ratio of the sizes of the pistons 34A and 34B.

As shown in FIGS. 1A, 1B and 1C, the housing 32 can be formed of three pieces, 32A, 32B and 32C. Housing piece 32C includes four valve seats 31, 33, 35 and 37 into which are positioned check valves 39, 41, 43 and 45. Check valves 39, 41, 43 and 45 can have threads 47, 49, 51 and 53 to screw the valves 39, 41, 43 and 45 into valve seats 31, 33, 35 and 37 having internal threads (not shown). Housing 32*c* can be provided with threads 55 and 57 to secure housings 32A and 32B to housing 32C. Check valves 41 and 45 are connected to conduit 59 and 61 which in turn are in fluid communication with a point of use for the fluid (not shown). Check valves 39 and 43 are connected with conduits 63 and 65 which, in turn, are connected to a reservoir for the fluid (not shown). In use, when pistons 34A and 34B move toward check valves 41 and 45, check valves 41 and 45 are open and check valves 39 and 43 are closed so that fluid is delivered through check valves 41 and 45 and conduits 59 and 61 to a point of use of the fluids. When pistons 34*a* and 34*b* move away from check valves 41 and 45, check valves 41 and 45 are closed and check valves 39 and 43 are open so that fluid moves into barrel 29A and 29B through check valves 39 and 43 and conduits 63 and 65 from a fluid reservoir.

Figure 2C:
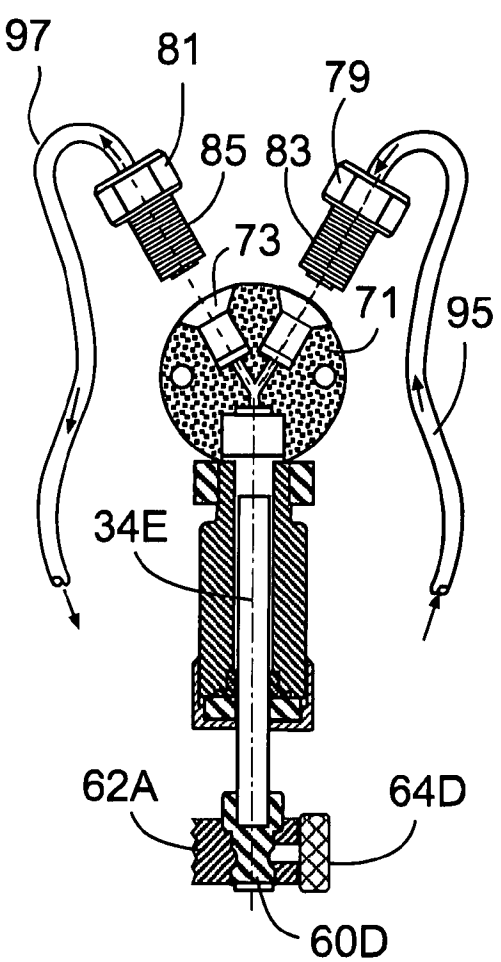
FIG. 2C is a cross-sectional view of the displacement pump and check valve apparatus of FIG. 2B taken along line 2C—2C.
Figure 2B:
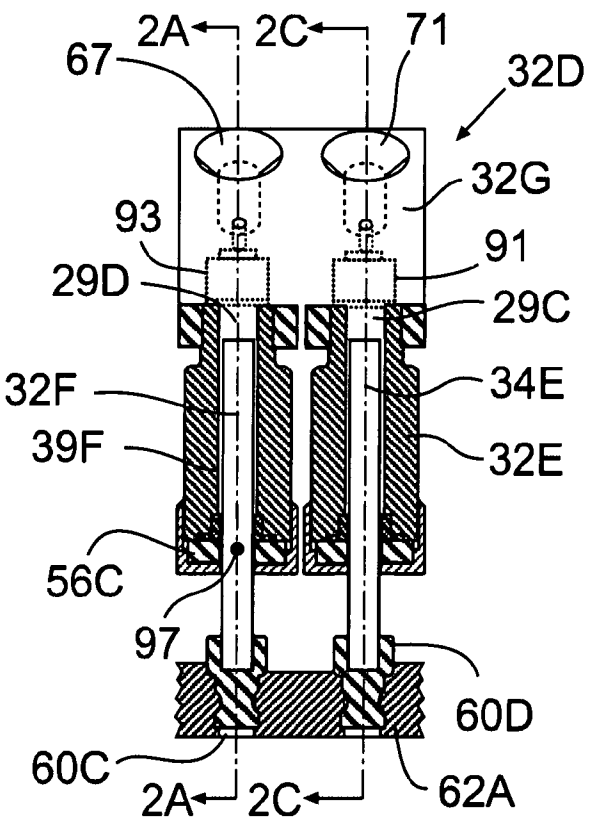
FIG. 2B is a front view of the displacement pump and check valve apparatus of FIG. 2A and 2C.
Figure 2A:
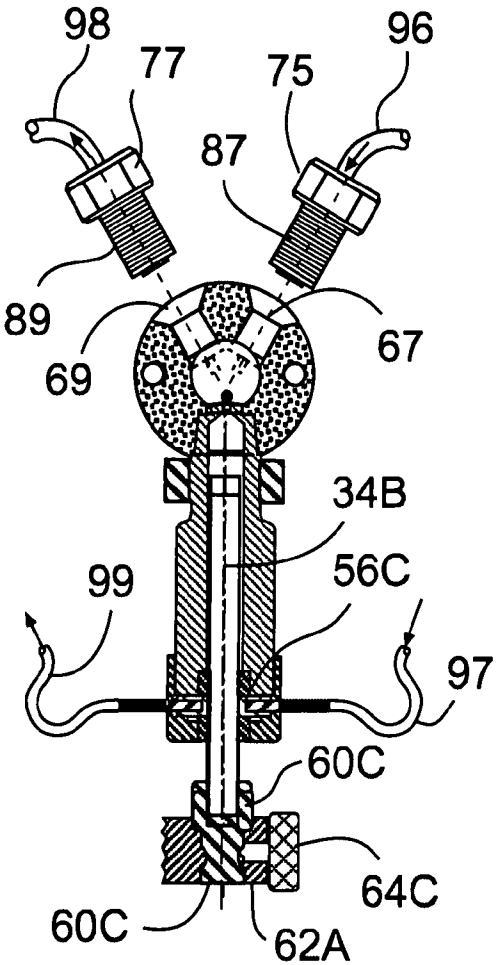
FIG. 2A is a cross-sectional view of the displacement pump and check valve apparatus of FIG. 2B taken along line 2A—2A.

FIGS. 2A, 2B and 2C show the embodiment of this invention wherein two liquids including a wash liquid for the pump seals are simultaneously pumped. Each piston 34C and 34D is positioned within a seal 56C or 56D which can be formed, from (UHMWPE) or the like and optional roulon guide 58*c* or 58D. The roulon guides 58C and 58D align pistons 34C and 34D into seals 56C and 56D. The pistons 34C and 34D reciprocate within seals 56C and 56D and roulon guides 54C and 54D. The pistons 34C and 34D are fixedly positioned in ferrules 60C and 60D which, in turn, are fixed within arm 62A by knobs 64C and 64D. Both pistons 34E and 34F move together when arm 62A is moved by motor 16 (FIG. 4). The volume ratio of the liquids delivered from barrels 29C and 29D with a single stroke of pistons 34E and 34F is controlled by the ratio of the sizes of the pistons 34E and 34F.

As shown in FIGS. 2A, 2B and 2C, the housing 32D can be formed of three pieces comprising piece 32E, 32F and 32G. Housing piece 32G includes four valve seats 67, 69, 71 and 73 into which are positioned check valves 75, 77, 79 and 81. Check valves 75, 77, 79 and 81 can have threads 83, 85, 87 and 89 to screw the valves 75, 77, 79 and 81 into valve seats 67, 69, 71 and 73 having internal threads (not shown). Housing 32*g* can be provided with threads 91 and 93 to secure housings 32E and 32F to housing 32G. Check valves 79 is connected to conduit 95 which in turn is connected to a reservoir for wash water (not shown). Check valve 81 is connected to conduit 97 which, in turn, is connected to seal 56C in order to deliver wash water to seal 56C. Conduit 99 is connected to seal 56C to remove wash water from seal 56C. The wash water substantially prevents build-up of contaminants within seal 56C. Check valve 75 is connected to conduit 96 which, in turn, is in fluid communication with a reservoir for a fluid (not shown). Check valve 77 is connected to conduit 98 which directs pumped fluid to a point of use (not shown). In use, when pistons 34A and 34B move toward check valves 77 and 79, check valves 81 and 83 are open and check valves 75 and 79 are closed so that fluid is delivered through check valve 77 and conduits 98 to a point of use of a fluid. In addition, wash water is delivered through check valve 81 and conduit 97. When pistons 34E and 34F move away from check valves 77 and 81, check valves 77 and 81 are closed and check valves 75 and 79 are open so that fluid moves into barrels 29C and 29D through check valves 75 and 79 and conduits 95 and 96 from a fluid reservoir (not shown).

Figure 3C:
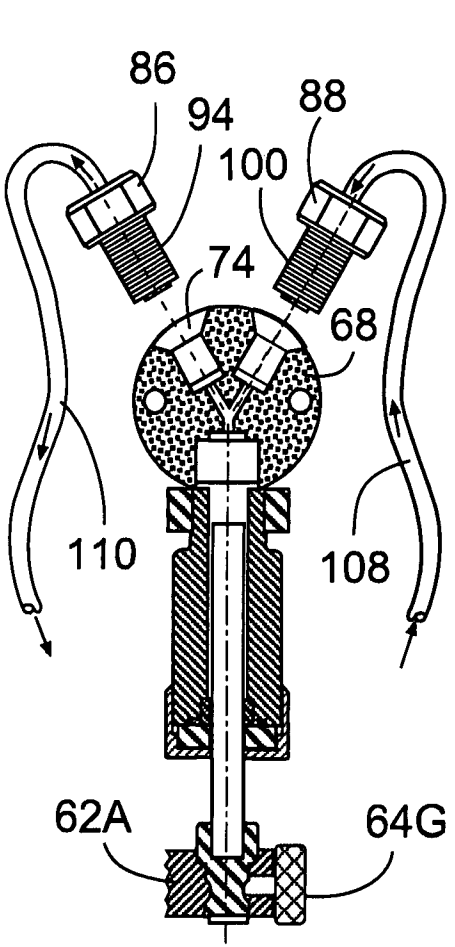
FIG. 3C is a cross-sectional view of the displacement pump and check valve apparatus of FIG. 3B taken along line 3C—3C.
Figure 3B:
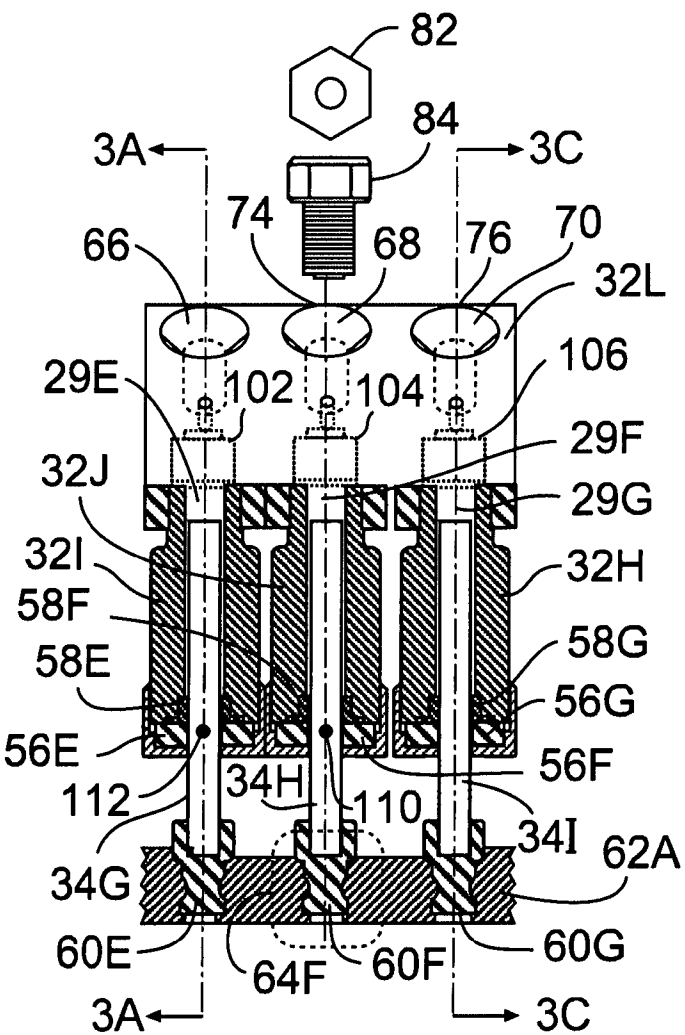
FIG. 3B is a front view of the displacement pump and check valve apparatus of FIG. 3A and 3C.
Figure 3A:
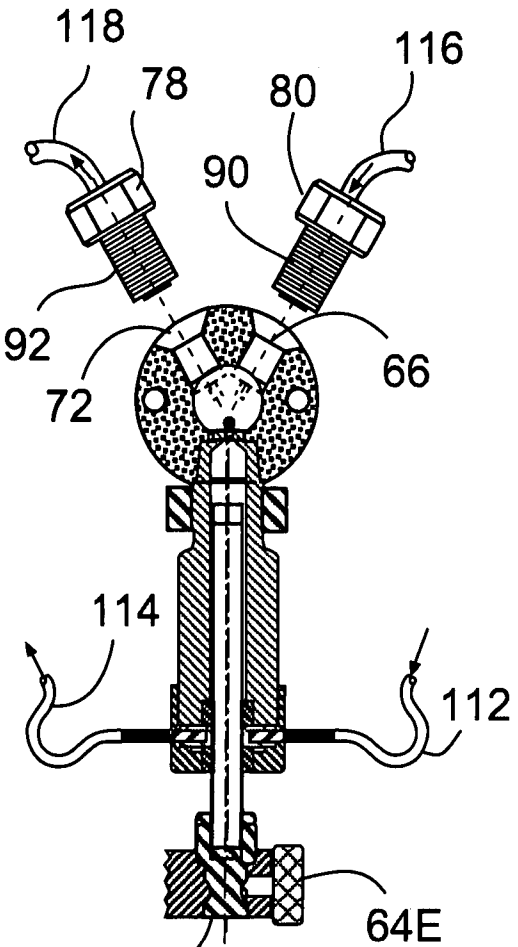
FIG. 3A is a cross-sectional view of the displacement pump and check valve apparatus of FIG. 3B taken along line 3A—3A.

FIGS. 3A, 3B and 3C show the embodiment of this invention wherein three liquids including a wash liquid for the pump seals are simultaneously pumped. Each piston 34G, 34H and 34I is positioned within a seal 56E, 56F or 56G which can be formed, from UHMWPE or the like and optional roulon guides 58E, 58F or 58G. The roulon guides 58E, 58F and 58G align pistons 34G, 34H and 34I into seals 56E, 56F and 56G. The pistons 34G, 34H and 34I reciprocate within seals 56E, 56F and 56G and roulon guides 54E, 54F and 54G. The pistons 34G, 34H and 34I are fixedly positioned in ferrules 60E, 60F and 60G which, in turn, are fixed within arm 62 by knobs 64E, 64F and 64G. All three pistons 34G, 34H and 34I move when arm 62A is moved. The volume ratio of the liquids delivered from barrels 29C, 29D and 29E with a single stroke of pistons 34G, 34H and 34I is controlled by the ratio of the sizes of the pistons 34G, 34H and 34I.

As shown in FIGS. 3A, 3B and 3C, the housing 32H can be formed of four pieces comprising pieces 32I, 32J, 32K and 32L. Housing piece 32I includes six valve seats 66, 68, 70, 72, 74 and 76 into which are positioned check valves 78, 80, 82, 84, 86 and 88. Check valves 78, 80, 82, 84, 86 and 88 can have threads e.g., 90, 92, 94 and 100 to screw the valves 78, 80, 82, 84, 86 and 88 into valve seats 66, 68, 70, 72, 74 and 76 having internal threads (not shown). Housing 32H can be provided with threads 102, 104 and 106 to secure housings 32I, 32J and 32K to housing 32H. Check valve 88 is connected to conduit 108 which in turn is connected to a reservoir for wash water (not shown). Check valve 86 is connected to conduit 110 which, in turn, is connected to seals 56E and 56F in order to deliver wash water to seals 56E and 56F. A conduit 112 connects seal 56F to seal 56E so that both seals 56E and 56F receive wash water. Conduit 114 is connected to seal 56E to remove wash water from seals 56E and 56F. Check valve 80 is connected to conduit 116 which, in turn, is in fluid communication with a reservoir for a fluid (not shown). Check valve 78 is connected to conduit 118 which directs pumped fluid to a point of use (not shown). In use, when pistons 34G, 34H and 34I move toward check valves 78, 82 and 86, check valves 78, 82 and 86 are open and check valves 80, 84 and 88 are closed so that fluid is delivered through check valves 78 and 82 and conduits 118 and 119 to a point of use of a fluid. In addition, wash water is delivered through check valve 86 and conduit 110. When pistons 34G, 34H and 34I move away from check valves 78, 82 and 86, check valves 78, 82 and 86 are closed and check valves 80, 84 and 88 are open so that fluid moves into barrels 29E, 29F and 29G through check valves 80, 84, and 88 from a fluid reservoir (not shown).

Figure 5:
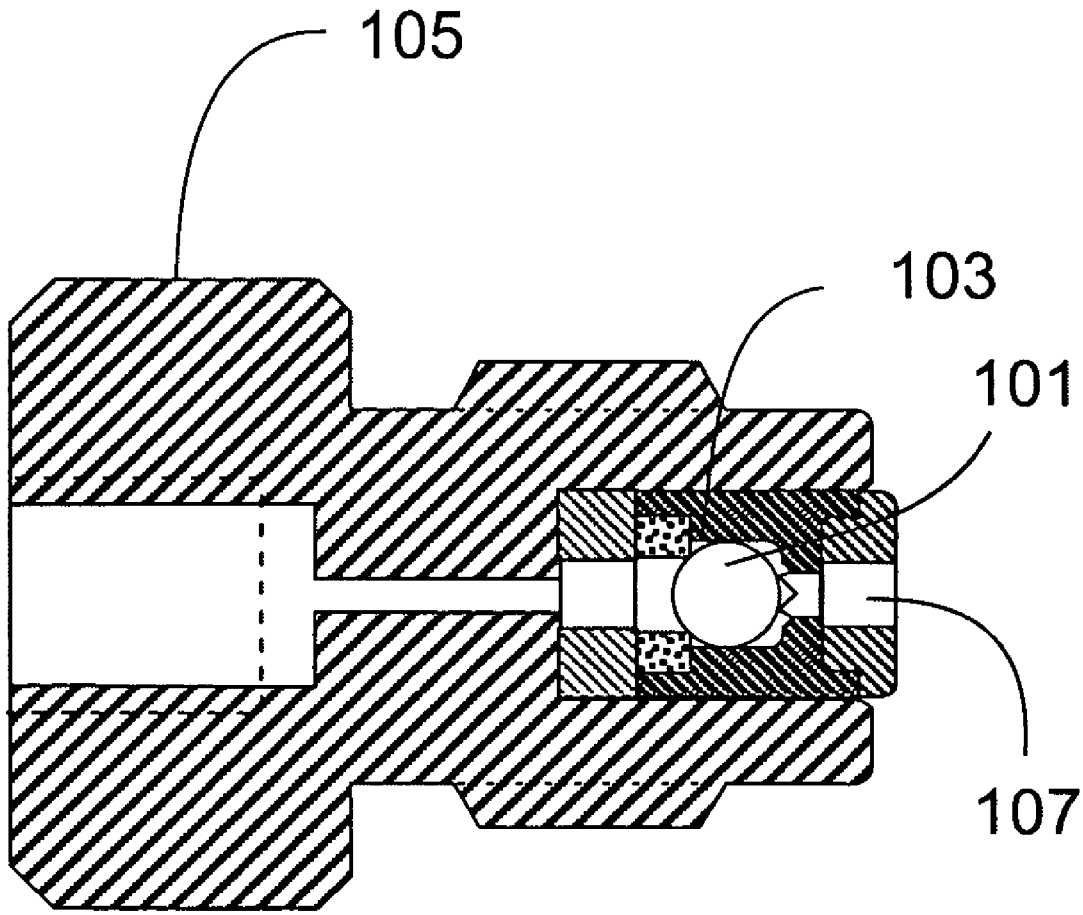
FIG. 5 is a cross-sectional view of the check valve useful in the present invention.

Referring to FIG. 5, the valve 41, like valves 39, 43 and 45 includes a movable ball 101 which moves within valve seat 103 to block either conduit 105 or conduit 107 to effect fluid flow as described above.

The invention claimed is:

1. A pump apparatus which comprises:

a plurality of pumps each comprising a displacement pump for pumping a fluid having a reciprocatable piston positioned within a housing having an interior wall spaced apart from said piston, an interior volume of said housing being in fluid communication with a fluid with a fluid inlet to a first check valve and a fluid outlet from a second check valve, said first check valve being in fluid communication with a point of use for said fluid, said second check valve being in fluid communication with a source of said fluid, said first check valve being open and said second check valve being closed when said piston moves toward said first check valve, said first check valve being closed and said second check valve being open when said piston moves away from said first check valve, each said piston of each said displacement pump being movable by a common motor and wherein a fluid pumped from one of said displacement pumps is directed to a seal of at least one of a second displacement pump, said seal positioned to prevent said fluid located within said interior volume from bypassing said piston.

2. The pump apparatus of claim 1 wherein said housing is formed of a transparent material.

3. The pump apparatus of claim 1 said piston is formed of sapphire.

4. The pump apparatus of any one of claims 1, 2 or 3 comprising two of said pumps.

5. The pump apparatus of any one of claims 1, 2 or 3 comprising three of said pumps.

6. A pump apparatus which comprises:

a plurality of pumps each comprising a displacement pump for pumping a fluid having a reciprocatable piston positioned within a housing having an interior wall spaced apart from said piston, fluid flow through each of said pumps being controlled by check valves, reciprocation of all reciprocal pistons being controlled form a common power source and wherein a fluid pumped from one of said displacement pumps is directed to a seal of at least one of a second displacement pump, said seal positioned to prevent said fluid located within said interior volume from bypassing said piston.

7. The pump of claim 6 wherein said piston is formed of a transparent material.

8. The pump apparatus of claim 6 wherein said piston is formed of sapphire.

9. The pump apparatus of any one of claims 6, 7 or 8 comprising two of said pumps.

10. The pump apparatus of any one of claims 6, 7 or 8 comprising three of said pumps.

* * * * *